US008905901B2

(12) United States Patent
Stewart et al.

(10) Patent No.: US 8,905,901 B2
(45) Date of Patent: Dec. 9, 2014

(54) POWER DRIVE EXERCISE APPARATUS

(76) Inventors: Thomas Stewart, Windber, PA (US); Paul Lando, Monkton, MD (US)

( * ) Notice: Subject to any disclaimer, the term of this patent is extended or adjusted under 35 U.S.C. 154(b) by 446 days.

(21) Appl. No.: 13/341,829

(22) Filed: Dec. 30, 2011

(65) Prior Publication Data

US 2013/0172159 A1 Jul. 4, 2013

(51) Int. Cl.
*A63B 22/00* (2006.01)
*A63B 71/00* (2006.01)
*A63B 21/008* (2006.01)

(52) U.S. Cl.
USPC ..... 482/112; 482/51; 473/441

(58) Field of Classification Search
USPC ..... 482/51, 83, 87, 112, 148; 473/441, 445
See application file for complete search history.

(56) References Cited

U.S. PATENT DOCUMENTS 4,614,345 A * 9/1986 Doughty ..... 273/381
5,743,821 A * 4/1998 Wirachowski ..... 473/441
6,575,879 B1 * 6/2003 Harney et al. ..... 482/54
6,761,650 B1 * 7/2004 Dettmann ..... 473/445
7,322,893 B2 * 1/2008 Bright ..... 473/441
7,377,883 B1 * 5/2008 Blanton ..... 482/90
2002/0193185 A1 * 12/2002 Pendlebury ..... 473/445

* cited by examiner

*Primary Examiner* — Loan H Thanh
*Assistant Examiner* — Jennifer M Deichl
(74) *Attorney, Agent, or Firm* — Picadio Sneath Miller & Norton, P.C.; Robert L. Wagner

(57) ABSTRACT

A device allows an individual the ability to easily adjust the resistance to perform pushing and pulling exercises in multiple directions. The device allows the individual the ability to exercise at variable levels of intensity with a simple adjustment. The amount of ballast weight may be adjusted to offer additional levels of rolling resistance. The device may be set to operate either in a straight line, or in multiple directions. The device may use pneumatic tires, in a three-wheel design, which permit the device to be used on multiple surfaces and allows for ease of maneuverability during use. Unlike current systems, which do not allow for pushing or pulling at varied heights, the device has a handle bar that may change its height with a simple adjustable locking mechanism that incorporates a counterbalance system to allow for ease of movement of a force arm.

1 Claim, 2 Drawing Sheets

POWER DRIVE EXERCISE APPARATUS

BACKGROUND OF THE INVENTION

The present invention relates to exercise devices and, more particularly, to exercise devices that provide dynamic, rolling, adjustable resistance in multiple directions.

Currently, there is no simple way for an individual to perform pushing and pulling exercises, in multiple directions, on any surface, with variable resistance. Previously designed push/pull exercise devices require manual loading of heavy weights, typically multiple 25-pound weights, onto metal skids that will damage interior or exterior surfaces. This procedure may not be possible for some individuals due to strength limitations. Moreover, these devices to not allow for exercise in multiple directions, as they are difficult to control when turning.

In some training settings, individuals have actually pushed cars or trucks to achieve the maximum resistance levels desired.

As can be seen, there is a need for a device that allows an individual the ability to easily adjust the resistance to perform pushing and pulling exercises in multiple directions.

SUMMARY OF THE INVENTION

In one aspect of the present invention, a device comprises a main body; first and second arms extending from the main body, the first and second arms pivotable about a handle shaft disposed through the main body; first and second wheels rotatably attached to opposite sides on a first end of the main body; a third wheel rotatably attached to a second, opposite end of the main body; a variable resistance system disposed inside the main body, the variable resistance system applying a resistance independently to each of the first and second wheels; and a variable resistance system adjustment mechanism permitting a user to adjust the resistance independently applied to each of the first and second wheels.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a device that allows an individual the ability to easily adjust the resistance to perform pushing and pulling exercises in multiple directions. The device allows the individual the ability to exercise at variable levels of intensity with a simple adjustment. The device may be set to operate either in a straight line, or in multiple directions. The device may use pneumatic tires, in a three-wheel design, which permit the device to be used on multiple surfaces and allows for ease of maneuverability during use. Unlike current systems, which do not allow for pushing or pulling at varied heights, the device of the present invention has a handle bar that may change its height with a simple adjustable locking mechanism that incorporates a counterbalance system to allow for ease of movement of a force arm.

Figure 1:
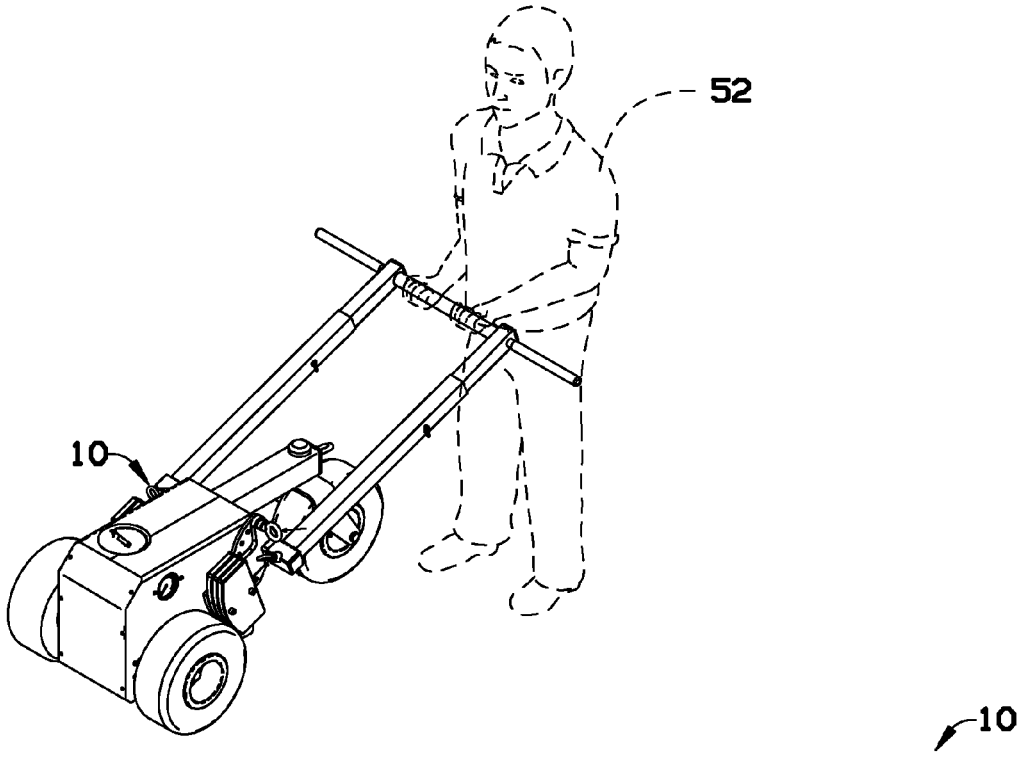
FIG. 1 is a perspective view of a power drive exercise machine according to an exemplary embodiment of the present invention.

Referring now to FIG. 1, a power drive exercise device 10 (also referred to as exercise device 10, device 10, or power drive machine 10) may be used by an individual 52 for pushing or pulling exercises.

Figure 2:
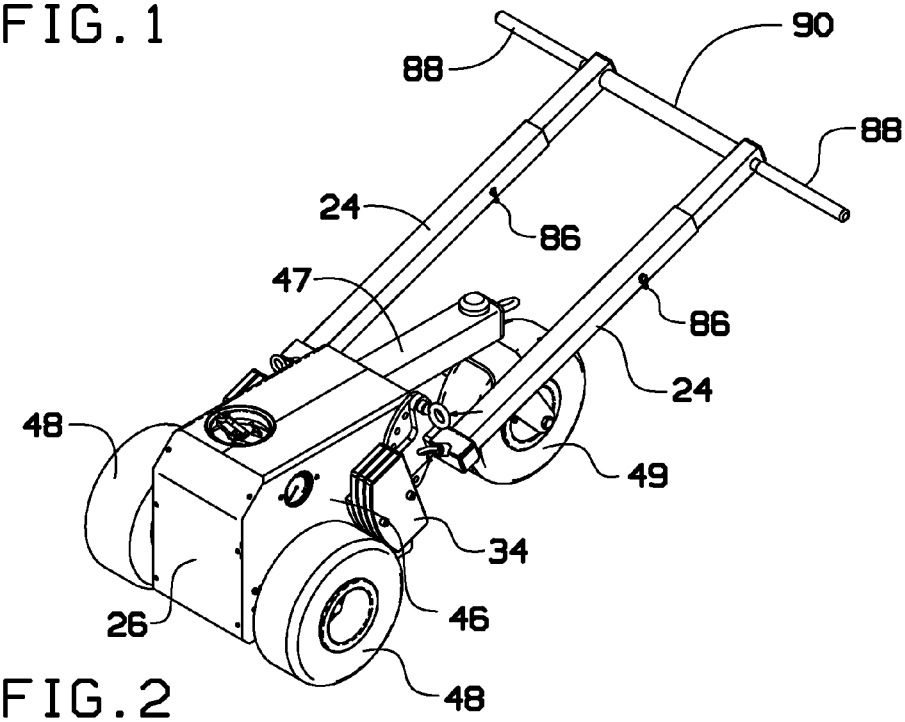
FIG. 2 is a close-up perspective view of the power drive exercise machine of FIG. 1.

Referring now to FIG. 2, the device 10 may include a main body 46 with two wheels 48 attached to the sides of the main body 46 at one end thereof. A third wheel 49 may be attached to the other end of the main body 46. In some embodiments, the third wheel 49 may be disposed on a tongue member 47 extending from the main body 48. In some embodiments, the third wheel 49 may include two wheels (not shown) in place of the single third wheel 49. The third wheel 49 may be locked in position, or may pivot, as discussed in greater detail below. A rear cover 26 may be disposed on the main body 46 to permit access to inside the main body 46.

Arms 24 may extend from each side of the main body 46. The length of the arms 24 may be adjustable via a locking pin 86, as discussed in greater detail below. A tanker bar 22 may be disposed between the arms 24 and a foam rubber tube 90 may be disposed along the tanker bar 22 for user comfort. Grips 88 may be disposed on each end of the tanker bar 22. A counter weight 34 may be disposed on an arm mechanism, as discussed below, for easily adjusting the position of the arms 24.

Figure 3:
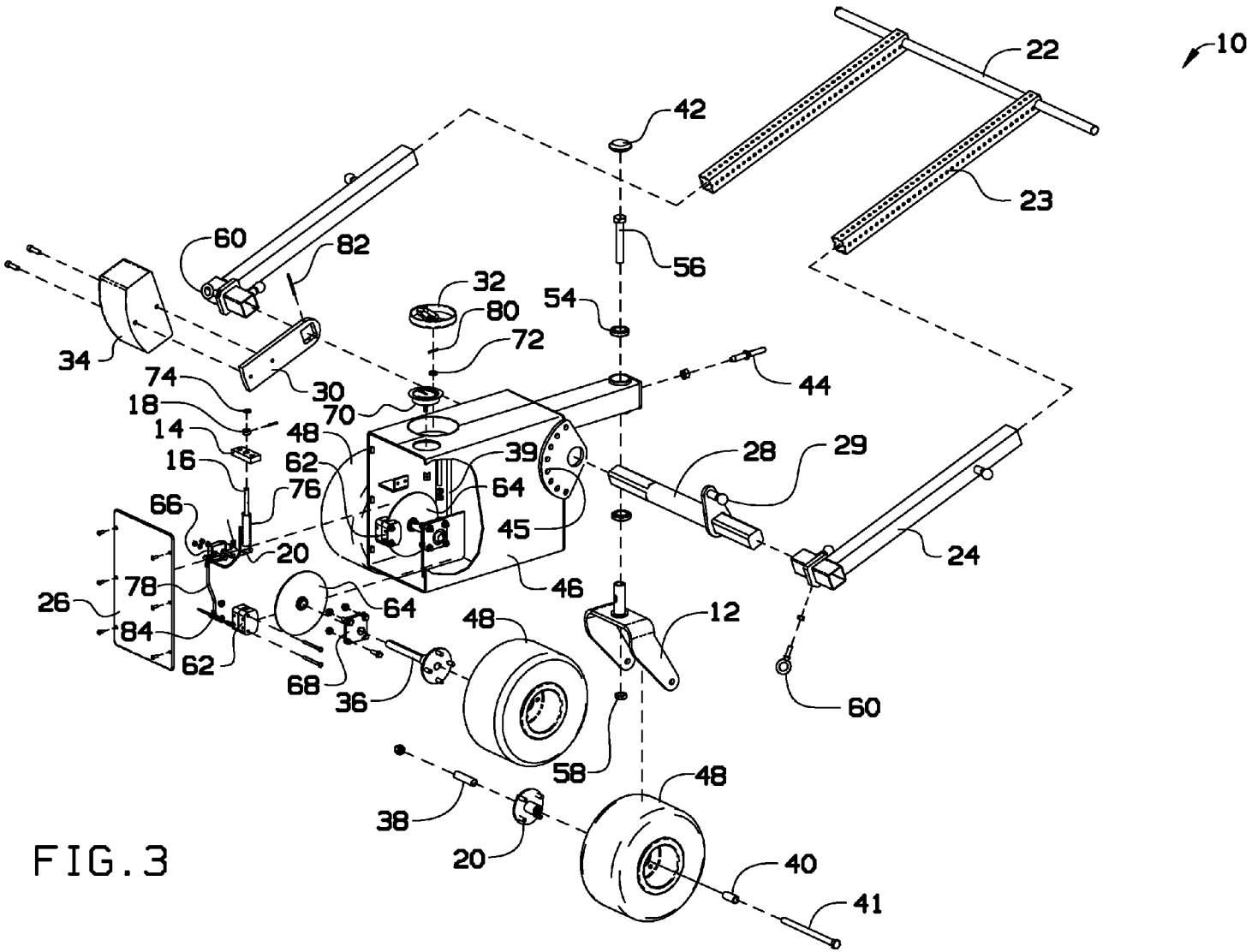
FIG. 3 is an exploded perspective view of the power drive exercise machine of FIG. 1.

Referring now to FIG. 3, a resistance system may be designed to provide resistance for the rotation of the wheels 48. The resistance system may be hydraulic, pneumatic or mechanical braking. For example, the resistance system may include a hand wheel 32 connected to a shaft 39 via a slotted spring pin 80 and a U-cup seal 72. A thrust bar 14 may be attached to a lead screw 16 via a shaft collar 18 and a thrust bearing/washer 74. Turning the hand wheel 32 may press on the thrust bar, pushing against a die spring 76, to trigger a master cylinder 66. The master cylinder 66 may be connected, via high pressure tubing 78 and a tubing tee 84, to first and second calipers 62. The master cylinder 66 may supply pressurized fluid to the first and second calipers 62. The calipers 62 may exert a force on first and second rotors 64. The rotors may be attached, via a flange mounting bearing 68, to a rear axle assembly 36. The rear axle assembly 36 may, in turn, be connected to the wheels 48. Thus, the hand wheel 32 may be turned to vary the rotational resistance of each wheel 48. A pressure gauge 70 may be disposed to, for example, show an indication of the pressure of the calipers 62 against the rotors 64. This split differential design may enable independent braking for steerable operation of the device 10.

As discussed above, the third wheel 49 may be fixed or may pivot to permit turning of the device 10. In some embodiments, the third wheel 49 may be attached to a castor bracket 12, via a wheel axle 20, front axle spacers 38, 40, and pin 41. The castor bracket 12 may attach through a hole in the tongue 47 via a rear wheel pivot bolt 56 and a castor stem cap 42. A castor eye bolt 44 may be removably disposed through the castor bracket 12 to fix the wheel 49 from pivoting. When the castor eye bolt 44 is removed from the castor bracket 12, the wheel 49 may pivot freely on the axis of the castor bracket 12.

The arms 24 may attach to the main body 46 via a handle shaft 28. On one side of the main body 46, a pin member 29 of the handle shaft 28 may fit into one of a plurality of holes 45 disposed in the main body 46. The handle shaft 28 may rotate and the pin member 29 may fix the handle shaft 28 into a selected position. On the other side of the main body (opposite the plurality of holes 45), a counter weight support 30 may be disposed to hold the counter weights 34. The counter weight support 30 may be attached to the handle shaft 28 via a spring pin 82 such that, when the pin member 29 is removed from the holes 45, the counter weights 34 may cause the arms 24 to raise via rotation of the handle shaft 28. The arms 24 may be attached at the ends of the handle shaft 28 via an arm eyebolt 60, for example.

The arms 24 may be a hollow, tubular member with a locking pin 86 near a distal end thereof. An inner arm member 23 may fit inside the arms 24. A plurality of holes may be disposed in the inner arm member 23 to permit the amount of the inner arm member 23 that extends from the arms 24 to vary, where the locking pin 86 may fix the overall length of the inner arm member 23 and the arms 24.

The device 10 may be light in weight and used primarily for agility training. The device may have added ballast weight (not shown) for maximizing the rolling resistance achievable without wheel skid on the surface being used. The mass is completely adjustable by means of adding ballast in a ballast reservoir.

The device 10 may be used in a variety of configurations. For example, a user may push or pull the device 10 with the third wheel 49 in a forward position or reverse position, and with the third wheel 49 locked or pivoting. A harness may be attached to the handle and the user may pull the harness for speed training, for example.

While the above description discusses specific embodiments for realizing the device 10, the specific embodiments may include equivalent substitutions within the scope of the present invention.

It should be understood, of course, that the foregoing relates to exemplary embodiments of the invention and that modifications may be made without departing from the spirit and scope of the invention as set forth in the following claims.

What is claimed is:

1. A device comprising:

a main body;

first and second arms extending from the main body and rotatably attached to the main body by way of a handle shaft;

a locking mechanism connected to the first and second arms that prevents the first and second arms from rotating;

a handle attached to the first and second arms;

first and second wheels rotatably attached to opposite sides on a first end of the main body;

a third wheel rotatably attached to a second, opposite end of the main body;

a variable resistance system disposed inside the main body, the variable resistance system applying a resistance independently to each of the first and second wheels;

a variable resistance system adjustment mechanism permitting a user to adjust the resistance independently applied to each of the first and second wheels;

a thrust bar coupled to the variable resistance adjustment mechanism;

a spring coupled to the thrust bar;

a master cylinder coupled to the spring and providing a pressurized fluid to the variable resistance system;

first and second calipers receiving the pressurized fluid from the master cylinder; and first and second rotors receiving pressure from the first and second calipers, the first and second rotors operably connected to the first and second wheels to provide rotational resistance to the first and second wheels.

* * * * *